US010793379B2

(12) United States Patent
Masuda

(10) Patent No.: US 10,793,379 B2
(45) Date of Patent: Oct. 6, 2020

(54) PAPER FEED APPARATUS AND IMAGE FORMING APPARATUS

(71) Applicant: Sharp Kabushiki Kaisha, Osaka (JP)

(72) Inventor: Junya Masuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/273,871

(22) Filed: Sep. 23, 2016

(65) Prior Publication Data

US 2017/0107066 A1 Apr. 20, 2017

(30) Foreign Application Priority Data

Oct. 19, 2015 (JP) ..... 2015-205471

(51) Int. Cl.

| | |
|---|---|
| ***B65H 1/26*** | (2006.01) |
| ***B65H 1/08*** | (2006.01) |
| ***G03G 15/00*** | (2006.01) |
| ***B65H 1/14*** | (2006.01) |
| ***B65H 1/04*** | (2006.01) |
| ***B65H 1/28*** | (2006.01) |

(52) U.S. Cl.

CPC ..... *B65H 1/08* (2013.01); *B65H 1/04* (2013.01); *B65H 1/14* (2013.01); *B65H 1/266* (2013.01); *B65H 1/28* (2013.01); *G03G 15/6502* (2013.01); *G03G 15/6511* (2013.01); *G03G 15/6529* (2013.01); *B65H 2403/544* (2013.01); *B65H 2405/112* (2013.01); *B65H 2405/113* (2013.01); *B65H 2405/114* (2013.01); *B65H 2405/15* (2013.01); *B65H 2601/322* (2013.01)

(58) Field of Classification Search

CPC ..... B65H 1/266; B65H 2402/441; B65H 2601/321; B65H 2405/111; B65H 2405/114; B65H 2601/322; B65H 2405/11171

See application file for complete search history.

(56) References Cited

U.S. PATENT DOCUMENTS

| | | | | |
|---|---|---|---|---|
| 6,603,952 | B2 * | 8/2003 | Hoene | B65H 1/14 271/157 |
| 8,342,513 | B2 | 1/2013 | Yamaguchi | |
| 8,439,343 | B2 * | 5/2013 | Yamaguchi | B65H 1/14 271/162 |
| 9,561,919 | B2 * | 2/2017 | Yanase | B65H 1/266 |

(Continued)

FOREIGN PATENT DOCUMENTS

| | | |
|---|---|---|
| JP | S59-137228 | 9/1984 |
| JP | 11-157672 | 6/1999 |

(Continued)

*Primary Examiner* — Howard J Sanders

(74) *Attorney, Agent, or Firm* — Renner, Otto, Boisselle & Sklar, LLP

(57) ABSTRACT

A paper feed apparatus in accordance with the present invention feeds printing paper stored in a printing paper storage unit. The printing paper storage unit includes: a paper stacking table on which the printing paper is stacked; and an erected member erected along a side of the paper stacking table. The erected member includes a low erected portion formed lower in a height direction than a surrounding portion of the erected member. The paper stacking table has a top face thereof located at a position as high as, or higher than, the low erected portion in the height direction.

6 Claims, 5 Drawing Sheets

(56) References Cited

U.S. PATENT DOCUMENTS

| | | | | |
|---|---|---|---|---|
| 2005/0151315 | A1* | 7/2005 | Yokoi | B65H 1/04<br>271/145 |
| 2017/0031296 | A1* | 2/2017 | Sato | B65H 3/66 |

FOREIGN PATENT DOCUMENTS

| | | |
|---|---|---|
| JP | 2009249175 | 10/2009 |
| JP | 2012166861 | 9/2012 |

* cited by examiner

PAPER FEED APPARATUS AND IMAGE FORMING APPARATUS

CROSS-REFERENCE TO RELATED APPLICATIONS

The present application hereby claims priority under 35 U.S.C. § 119(a) on Patent Application No. 2015-205471 filed in Japan on Oct. 19, 2015, the entire contents of which are hereby incorporated herein by reference.

FIELD OF THE INVENTION

The present invention relates to paper feed apparatuses and image forming apparatuses feeding printing paper stored in a printing paper storage unit.

BACKGROUND OF THE INVENTION

Image forming apparatuses are used increasingly frequently. Accordingly, an increased maximum paper storage capacity is desirable to decrease the frequency of replenishing printing paper. One solution to this issue is the use of large-capacity paper feed trays in which numerous sheets of printing paper can be stacked. Such a paper feed tray however has so tall sidewalls for the bottom of the tray that the user will face difficulty in reaching deep down to the tray bottom to restock printing paper.

Another solution proposed for an increased maximum paper storage capacity is a tandem paper feed apparatus in which printing paper is stacked in both a paper feeding position and an auxiliary position that are located parallel to each other.

JP 11-157672 A discloses a paper feed apparatus including a main printing paper storage unit and an auxiliary printing paper storage unit that are provided parallel to each other. The paper feed apparatus is structured so that the auxiliary printing paper storage unit can be pulled out by a greater distance than the main printing paper storage unit. A protruding shield member is provided to close the gap between the two storage units when the main printing paper storage unit is set.

The rectangular printing paper storage units in the paper feed apparatus disclosed in JP 11-157672 A have sidewalls on three sides. No sidewall is provided on the remaining side. This open side allows a greater space for access, but in return for this benefit, creates a new problem that printing paper could fall off over that side.

The present invention, conceived to address these problems, has an object of providing a paper feed apparatus and an image forming apparatus each capable of allowing smooth stacking of printing paper for improved ease in paper restocking.

SUMMARY OF THE INVENTION

The present invention is directed to a paper feed apparatus including a printing paper storage unit, the paper feed apparatus feeding printing paper stored in the printing paper storage unit, the printing paper storage unit including: a paper stacking table on which the printing paper is stacked; and an erected member erected along a side of the paper stacking table, the erected member including a low erected portion formed lower in a printing paper stacking direction than a surrounding portion of the erected member, and the paper stacking table having a top face thereof located at a position as high as, or higher than, the low erected portion in the printing paper stacking direction.

In the paper feed apparatus in accordance with the present invention, the paper stacking table may include a paper stack notch portion at a position facing the low erected portion, the paper stack notch portion being formed by cutting out a part of the paper stacking table.

In the paper feed apparatus in accordance with the present invention, the printing paper storage unit may include a first regulating member in the paper stack notch portion, the first regulating member being configured to regulate a position of the printing paper stacked on the paper stacking table, and the first regulating member may project upward in the printing paper stacking direction above the paper stacking table.

In the paper feed apparatus in accordance with the present invention, the first regulating member may be disposed out of alignment with the low erected portion.

In the paper feed apparatus in accordance with the present invention, the first regulating member may be configured to pivot around a supporting point and when pivoted, retract below the paper stacking table.

In the paper feed apparatus in accordance with the present invention, the printing paper storage unit may include a pair of second regulating members configured to regulate the position of the printing paper stacked on the paper stacking table, the pair of second regulating members may face each other in a direction perpendicular to a direction in which the first regulating member regulates the printing paper, and the pair of second regulating members may be separated from each other by a distance greater than a width of the low erected portion in the direction in which the pair of second regulating members faces each other.

In the paper feed apparatus in accordance with the present invention, the paper feed apparatus may further include: a housing configured to house the printing paper storage unit therein; and a manual operating portion disposed on a front face of the housing, the manual operating portion being configured to, when operated, allow the printing paper storage unit to be pulled out of the housing, and the low erected portion may be disposed in a direction parallel to a direction in which the printing paper storage unit is pulled out of the housing.

The present invention is also directed to an image forming apparatus including the paper feed apparatus in accordance with the present invention, the image forming apparatus forming an image on the printing paper fed from the paper feed apparatus.

According to the present invention, the low erected portion is formed lower than the paper stacking table. Therefore, the paper stacking table has a partially open structure. This structure allows the user to, in stacking printing paper, extend his/her hand over the low erected portion without touching the erected member. The user can hence stack printing paper smoothly. The structure can thus improve ease in paper restocking.

DESCRIPTION OF EMBODIMENTS

The following will describe an image forming apparatus in accordance with an embodiment of the present invention in reference to drawings.

Figure 1:
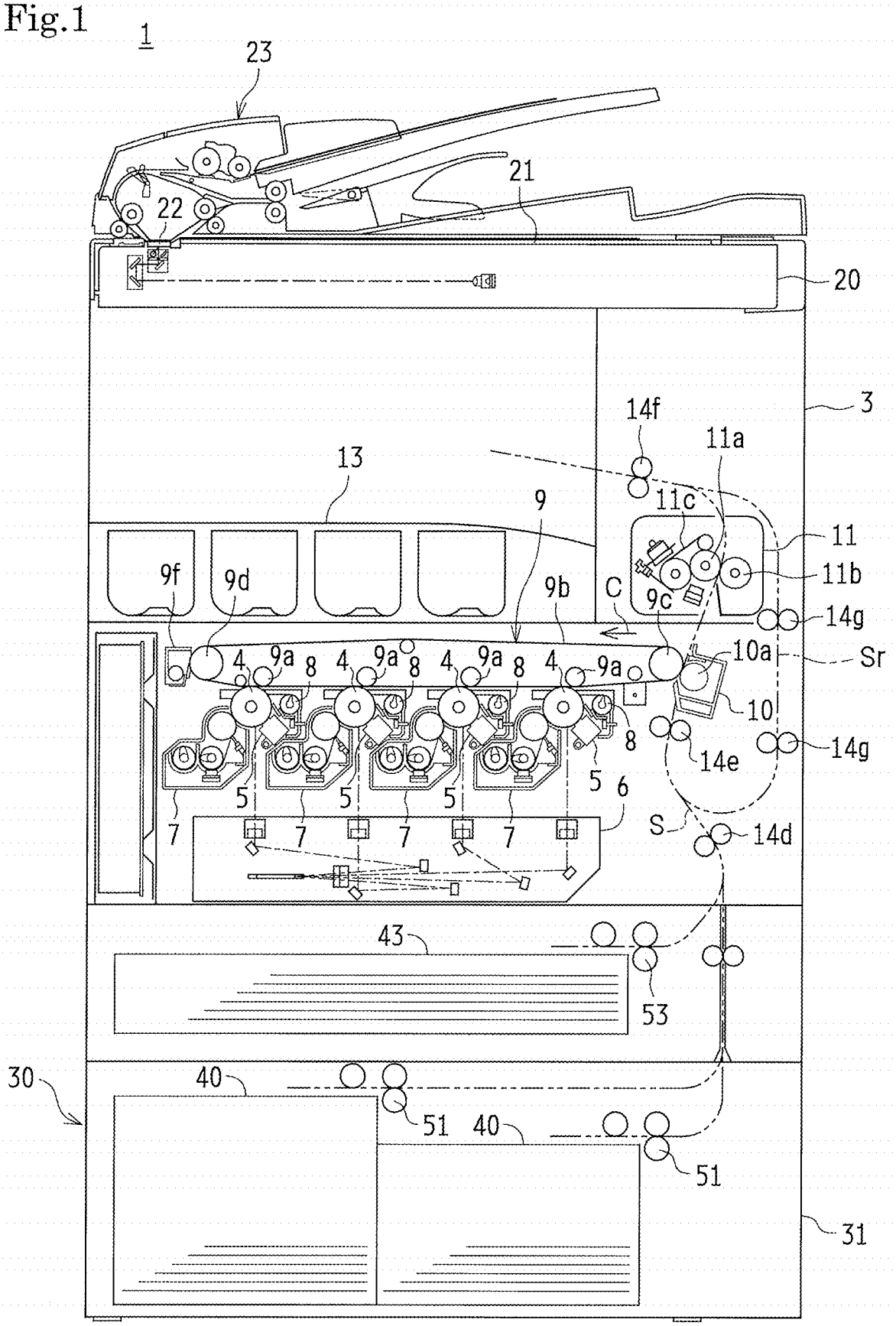
FIG. 1 is a schematic side view of an image forming apparatus in accordance with an embodiment of the present invention.

FIG. 1 is a schematic side view of an image forming apparatus 1 in accordance with an embodiment of the present invention.

The image forming apparatus 1 has a copying function of reading an original document and forming an image of the document on printing paper. The image forming apparatus 1 includes a scan unit 20, an original transport unit 23 disposed over the scan unit 20, an image forming unit 3 disposed under the scan unit 20, a paper feed apparatus 30, and a paper stacking tray 13.

The original transport unit 23 is supported so as to be freely opened and closed over the scan unit 20. When the original transport unit 23 is opened, an original stage 21 disposed on top of the scan unit 20 is exposed in such a manner that the user can manually place an original document on the original stage 21. Besides the original stage 21, the scan unit 20 is provided on top thereof with an original transmitting unit 22. The original transport unit 23 automatically transports the original document placed on the original stage 21 onto the original transmitting unit 22. The scan unit 20 reads the original document placed on the original stage 21 or the original document transported from the original transport unit 23 to generate image data.

The image forming apparatus 1 handles image data representing color images composed of black (K), cyan (C), magenta (M), and yellow (Y) colors or monochrome images composed of a single color (e.g., black). The image forming unit 3 includes four sets of a development apparatus 7, a photosensitive drum 4, a drum cleaning apparatus 8, and a charging unit 5 to form four toner images of different colors (i.e., black, cyan, magenta, and yellow). Each set is dedicated to a different one of the four colors to constitute an image station for that color (the four sets hence constitute a total of four image stations).

The drum cleaning apparatus 8 removes and collects residual toner from the surface of the photosensitive drum 4. The charging unit 5 uniformly charges the surface of the photosensitive drum 4 to a predetermined electric potential. An optical scan apparatus 6 exposes the surface of the photosensitive drum 4 to light to form an electrostatic latent image thereon. The development apparatus 7 develops the electrostatic latent image on the surface of the photosensitive drum 4 to form a toner image on the surface of the photosensitive drum 4. This series of processes is repeated to form toner images of different colors on the surfaces of the photosensitive drums 4.

There is provided an intermediate transfer belt unit 9 above the photosensitive drums 4. The intermediate transfer belt unit 9 includes four intermediate transfer rollers 9*a*, an intermediate transfer belt 9*b*, an intermediate transfer belt drive roller 9*c*, an intermediate transfer belt idler roller 9*d*, and a belt cleaning apparatus 9*f*. The intermediate transfer belt 9*b* is stretched and suspended by the intermediate transfer belt drive roller 9*c*, the intermediate transfer belt idler roller 9*d*, and the four intermediate transfer rollers 9*a*. The intermediate transfer belt drive roller 9*c*, connected to a drive unit (not shown), is driven to rotate, which in turn rotates the intermediate transfer belt 9*b* in the direction indicated by arrow C. The four intermediate transfer rollers 9*a* are pressed onto the respective photosensitive drums 4 via the intermediate transfer belt 9*b*. The belt cleaning apparatus 9*f* removes and collects residual toner from the surface of the intermediate transfer belt 9*b*. The toner images of different colors formed on the surfaces of the photosensitive drums 4 are then successively transferred to the surface of the intermediate transfer belt 9*b* in a superimposing manner to form a color toner image thereon.

A transfer roller 10*a* for a secondary transfer apparatus 10 forms a nip region between itself and the intermediate transfer belt 9*b* so that the printing paper transported via a printing paper transport path S can be nipped in the nip region for further transport. The toner image on the surface of the intermediate transfer belt 9*b* is transferred to the printing paper while the printing paper is passing through the nip region. The printing paper is then transported to a fixing apparatus 11.

The fixing apparatus 11 includes a fixing roller 11*a* and a pressure roller 11*b* that rotate while sandwiching the printing paper between them. The fixing apparatus 11 sandwiches, in a nip section between the fixing roller 11*a* and the pressure roller 11*b*, the printing paper onto which the toner image has been transferred and applies heat and pressure to the toner image, thereby fixing the toner image onto the printing paper. The fixing apparatus 11 is provided with a heating unit 11*c* for heating the fixing roller 11*a*.

The paper feed apparatus 30 includes printing paper storage units 40 storing printing paper used in image forming and is disposed below the optical scan apparatus 6. The printing paper fed from the paper feed apparatus 30 is transported via the printing paper transport path S, hence passing through, for example, the secondary transfer apparatus 10 and the fixing apparatus 11, and discharged to the paper stacking tray 13 via discharge rollers 14*f*. The paper feed apparatus 30 will be described later in detail in reference to FIGS. 2 to 6.

The printing paper transport path S is provided with registration rollers 14*e*, transport rollers 14*d*, the aforementioned discharge rollers 14*f*, and reverse transport rollers 14*g*. The registration rollers 14*e* temporarily stop the printing paper, align the leading end of the printing paper, and then starts transporting the printing paper in synchronism with the transfer of the color toner image in the nip region between the intermediate transfer belt 9*b* and the transfer roller 10*a*. The transport rollers 14*d* promote the transport of the printing paper.

To form an image on the backside of the printing paper as well as on the front side thereof, the printing paper is transported back from the discharge rollers 14*f* Then, the printing paper is transported via a turn-over path Sr where the printing paper is turned over and guided again to the registration rollers 14*e*. An image is then formed on the backside in the same manner as on the front side before the printing paper is discharged to the paper stacking tray 13.

Figure 2:
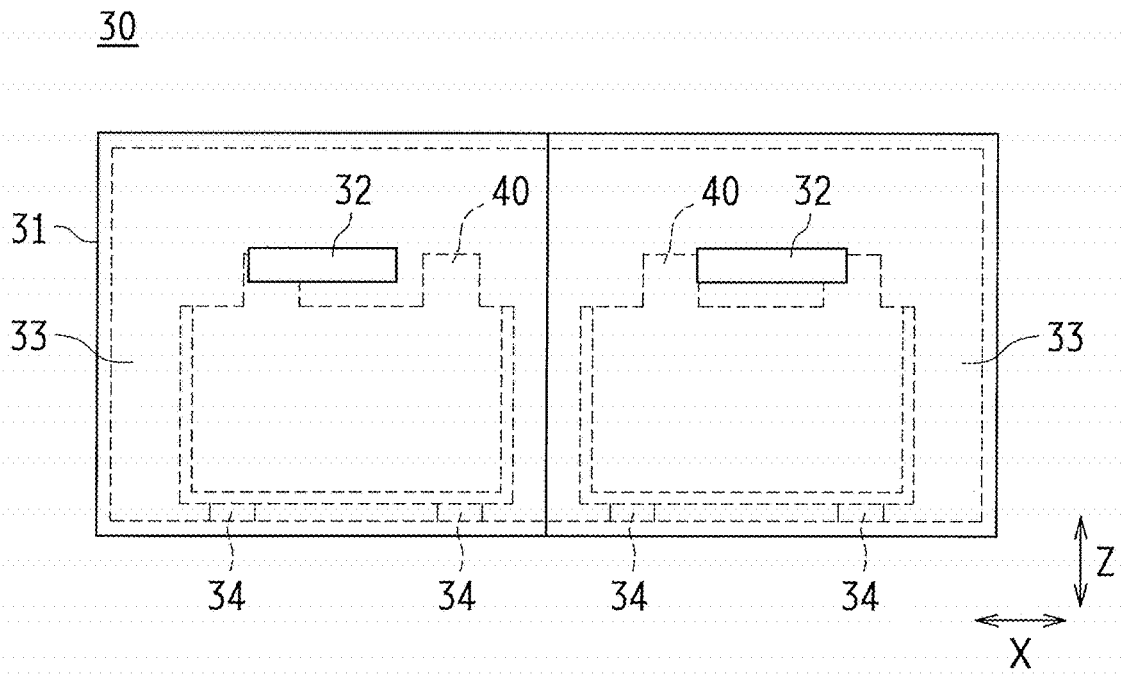
FIG. 2 is a front exterior view of a paper feed apparatus in accordance with a first embodiment of the present invention.

FIG. 2 is a front exterior view of the paper feed apparatus 30 in accordance with a first embodiment of the present invention.

The paper feed apparatus 30 in accordance with the first embodiment of the present invention includes the aforementioned two printing paper storage units 40 and a housing 31. The printing paper storage units 40 are disposed side by side to store printing paper. The housing 31 contains therein these two printing paper storage units 40.

The housing 31 is formed like a hollow rectangular parallelepiped with an open front. The housing 31 is provided on the front side thereof with two front panels 33 that are independent from the housing 31 to cover the front of the housing 31. Throughout the following description, the direction in which the two front panels 33 are arranged may be referred to as width direction X for convenience. The two printing paper storage units 40 are arranged side by side in width direction X in such a manner as to face the respective front panels 33. Printing paper is stacked in height direction Z in the printing paper storage units 40. In other words, height direction Z corresponds to the direction in which printing paper is stacked ("printing paper stacking direction").

Each front panel 33 has a manual operating portion 32 on the external face thereof and is connected to the housing 31 via rails 34. The user can disconnect the front panel 33 from the housing 31 by pulling the manual operating portion 32 in the out-of-paper direction in FIG. 2. The manual operating portion 32 is, for example, a handle and when grabbed, allows the user to move the front panel 33. This is not the only possible structure of the manual operating portion 32. The manual operating portion 32 may alternatively be, for example, a concavity in the front panel 33 or shaped otherwise in a suitable manner.

Figure 3:
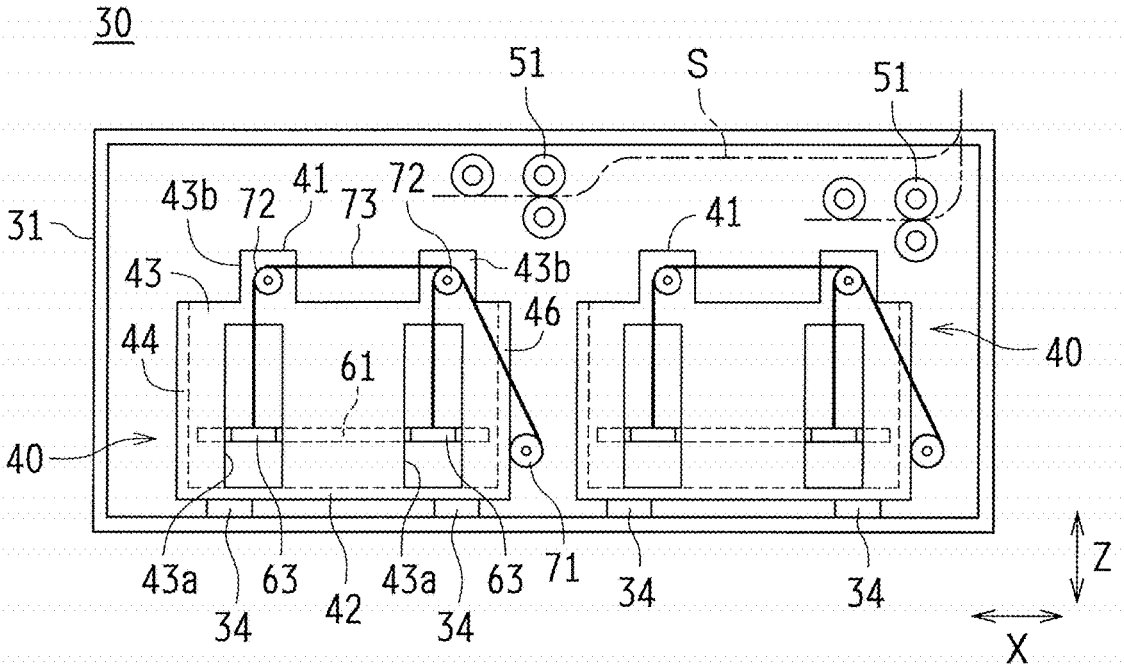
FIG. 3 is an interior view of the paper feed apparatus shown in FIG. 2 without front panels.
Figure 4:
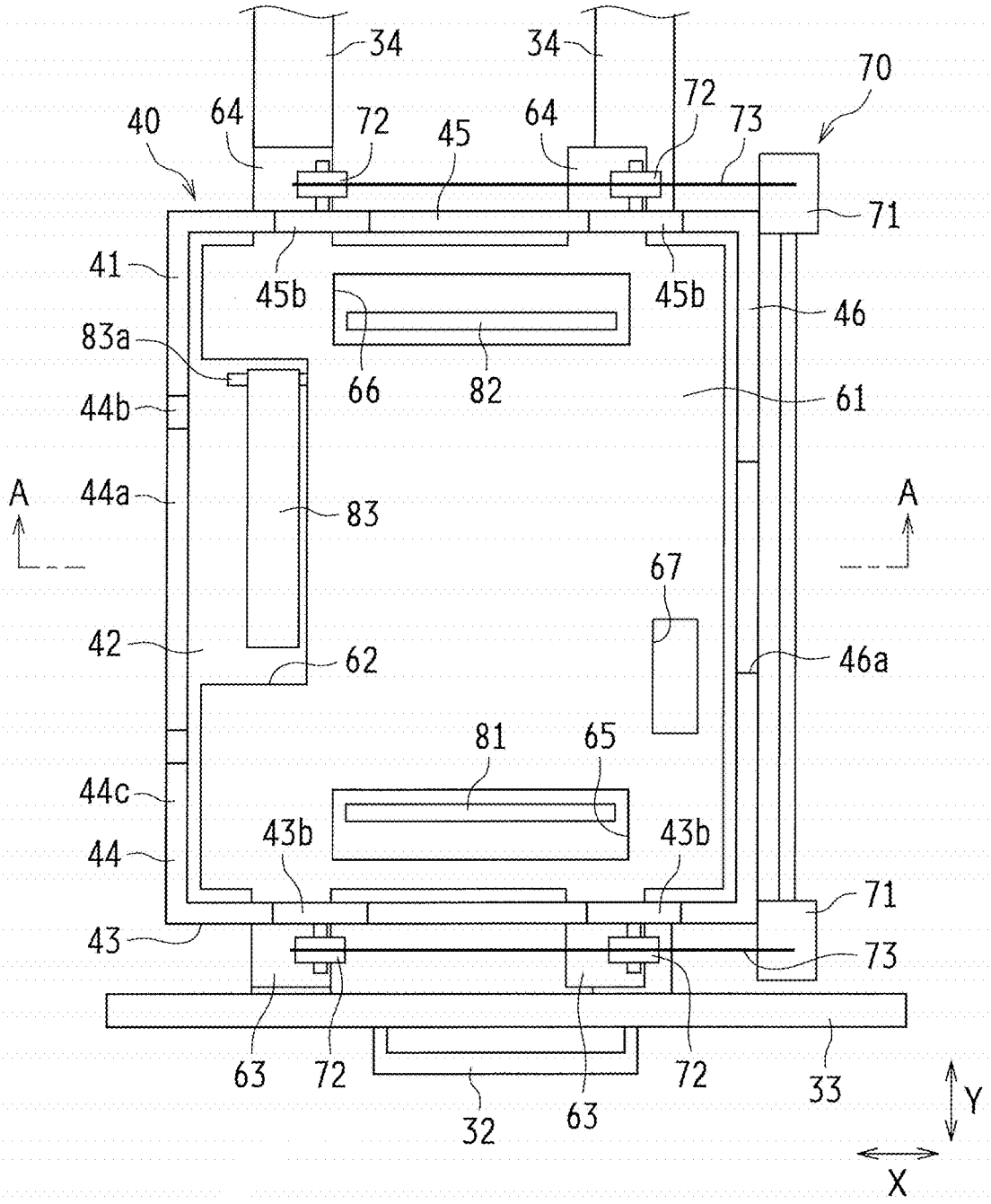
FIG. 4 is a schematic top view of a printing paper storage unit pulled out of a housing.
Figure 5:
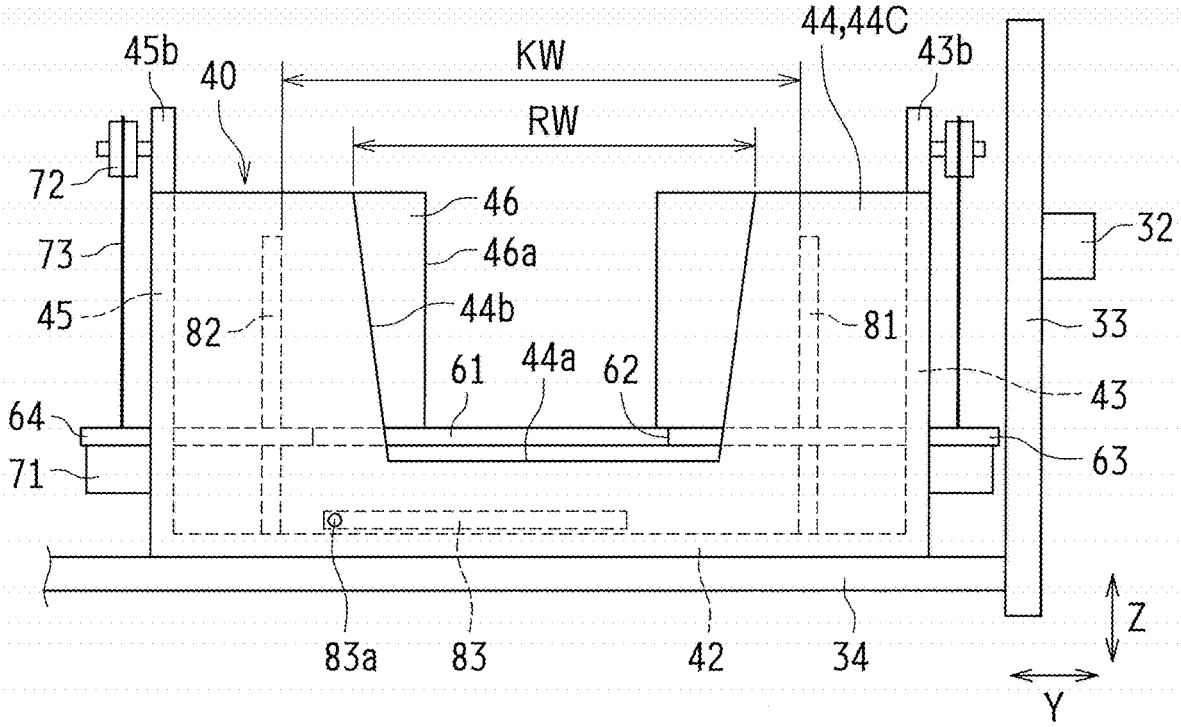
FIG. 5 is a schematic side view of the printing paper storage unit shown in FIG. 4 as it is viewed from a first side face thereof.
Figure 6:
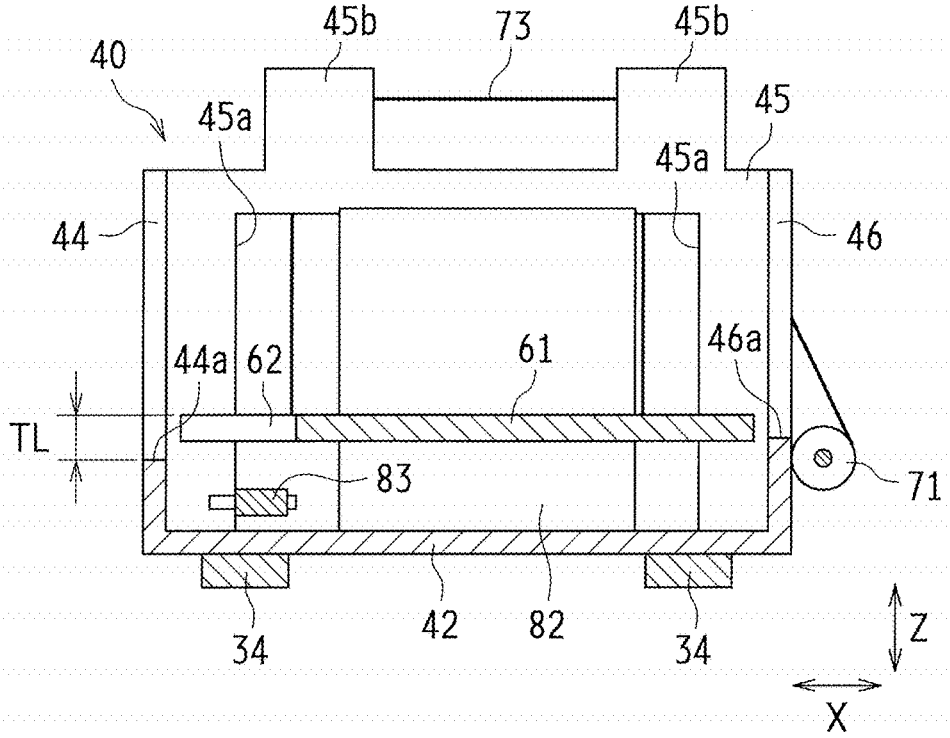
FIG. 6 is a cross-sectional view, taken along arrow A-A, of the printing paper storage unit shown in FIG. 4.

FIG. 3 is an interior view of the paper feed apparatus 30 shown in FIG. 2 with the front panels 33 being removed. FIG. 4 is a schematic top view of the printing paper storage unit 40 pulled out of the housing 31. FIG. 5 is a schematic side view of the printing paper storage unit 40 shown in FIG. 4 as it is viewed from a first side face thereof. FIG. 6 is a cross-sectional view, taken along arrow A-A, of the printing paper storage unit 40 shown in FIG. 4. The two printing paper storage units 40 have substantially the same structure. FIGS. 4 to 6 therefore show only one of the printing paper storage units 40, and no description is given as to the other printing paper storage unit 40.

In the housing 31, each of the two printing paper storage units 40 has the two rails 34 and a feeding portion 51. As mentioned earlier, the printing paper storage unit 40 is structured so that it can be pulled out through the open front of the housing 31. Throughout the following description, the direction in which the printing paper storage unit 40 is moved may be referred to as depth direction Y. Additionally, for convenience of description, in relation to depth direction Y, the direction in which the printing paper storage unit 40 is pulled out of the housing 31 may be referred to as "frontal" or "front" (i.e., the bottom in FIG. 4), and the direction in which the printing paper storage unit 40 is pushed into the housing 31 may be referred to as "rear" (i.e., the top in FIG. 4).

The rails 34 are elongate, freely extendable and compressible rails and structured so that the printing paper storage unit 40 can be placed on the bottom of the housing 31 via the rails 34. Each rail 34 is connected at an end thereof to the front panel 33 and extended and compressed in accordance with a motion of the front panel 33. In the present embodiment, each printing paper storage unit 40 has the two rails 34. Alternatively, there may be provided a different number of the rails 34 in a suitable manner. Furthermore, the rails 34 may be disposed on side faces of the printing paper storage unit 40.

The feeding portion 51 is composed primarily of a pickup roller and a pair of separation rollers and located above the printing paper storage unit 40. The pickup roller is moved into contact with printing paper on the printing paper storage unit 40 and has an additional sensor function of sensing the printing paper from the force with which the pickup roller is pressed to the printing paper. The pair of separation rollers sandwiches the printing paper delivered from the pickup roller to separate the printing paper into individual sheets for transport to the printing paper transport path S. The feeding portion 51, although not shown in the drawings, is supported pivotally by the housing 31 or the printing paper storage unit 40 in a suitable manner. The parts of the printing paper transport path S that connect to the two feeding portions 51 are configured to merge at a periphery of the housing 31. The housing 31 has, for example, an opening in accordance with the position of the printing paper transport path S. The printing paper is fed to a part of the printing paper transport path S that is inside the image forming unit 3 through that opening.

Each printing paper storage unit 40 includes a paper stacking table 61 on which the printing paper is stacked and an erected member 41 erected on all four sides of the paper stacking table 61. Specifically, the printing paper storage unit 40 is formed like a hollow rectangular parallelepiped with an open top and contains therein the paper stacking table 61 shaped substantially like a rectangular plate. The erected member 41 is an equivalent of the sidewalls of a rectangular parallelepiped. The printing paper storage unit 40 includes a storage bottom plate 42 on the bottom thereof, a front plate 43 erected on one of the four sides of the storage bottom plate 42 (on the bottom side of the storage bottom plate 42 in FIG. 4), a first side plate 44 erected on another side of the storage bottom plate 42 (on the left side of the storage bottom plate 42 in FIG. 4), a rear plate 45 erected on a further side of the storage bottom plate 42 (on the top side of the storage bottom plate 42 in FIG. 4), and a second side plate 46 erected on the remaining side of the storage bottom plate 42 (on the right side of the storage bottom plate 42 in FIG. 4).

The front plate 43 is provided with two frontal elevation holes 43*a* elongated in height direction Z and two frontal axial support portions 43*b* projecting upward.

The first side plate 44 has a low erected portion 44*a* that has a lower dimension in height direction Z than a surrounding portion of the first side plate 44. In other words, the first side plate 44 is substantially rectangular, but has a trapezoidal part thereof cut out in order to form the low erected portion 44*a*. The low erected portion 44*a* is located substantially in the middle of the first side plate 44 in depth direction Y and has a low-portion width RW in depth direction Y that is adequately greater than the human hand. Specifically, the low-portion width RW is set to approximately 15 cm in the present embodiment. An incline portion 44*b* tilted with respect to height direction Z is provided at each end of the low erected portion 44*a* in depth direction Y. As a result, the area that is opened up by the provision of the low erected portion 44*a* on a side of the first side plate 44 has an increasingly greater dimension (width) in depth direction Y toward the top part thereof.

Having substantially the same shape as the front plate 43, the rear plate 45 is provided with two rear elevation holes 45*a* elongated in height direction Z and two rear axial support portions 45*b* projecting upward.

The second side plate 46 has an opposite low portion 46*a* that has a lower dimension in height direction Z than a surrounding portion of the second side plate 46. The opposite low portion 46*a* is located opposite the low erected portion 44*a* in width direction X. In other words, the second side plate 46 is substantially rectangular, but has a rectangular part thereof cut out in order to form the opposite low portion 46*a*.

The paper stacking table 61 is a substantially rectangular flat plate slightly smaller in size than the storage bottom plate 42. Accordingly, the paper stacking table 61 substantially conceals the entire storage bottom plate 42 when the printing paper storage unit 40 is viewed from the top (see FIG. 4). In addition, the paper stacking table 61 has a paper stack notch portion 62, frontal protrusion portions 63, rear protrusion portions 64, a frontal regulating hole 65, a rear regulating hole 66, and a printing paper detecting hole 67. The paper stacking table 61 is suspended by an elevating unit 70 so that the top face of the paper stacking table 61 is maintained at a position higher than the low erected portion 44*a*. The height of the top face of the paper stacking table 61 as measured from the low erected portion 44*a* ("stack height TL") is set to approximately a few centimeters in the present embodiment. In other words, the paper stacking table 61 only needs not to be positioned lower than the low erected portion 44*a*. The paper stacking table 61 is disposed so that the top face thereof is located at a position as high as, or higher than, the low erected portion 44*a* in height direction Z.

The paper stack notch portion 62 is formed by cutting out a part of the paper stacking table 61 facing the low erected portion 44*a*. In other words, the paper stack notch portion 62 is provided on a side of the paper stacking table 61 facing the first side plate 44 (on the left side of the paper stacking table 61 in FIG. 4) and has substantially the same dimension of approximately 15 cm in depth direction Y as the low erected portion 44*a* and a dimension of approximately 4 cm in width direction X.

The two frontal protrusion portions 63 are disposed at positions facing the frontal elevation holes 43*a* on a side of the paper stacking table 61 facing the front plate 43 (on the bottom side of the paper stacking table 61 in FIG. 4). The frontal protrusion portions 63 are inserted into the frontal elevation holes 43*a* and project out of the erected member 41.

Having substantially the same shape as the frontal protrusion portions 63, the two rear protrusion portions 64 are disposed at positions facing the rear elevation holes 45*a* on a side of the paper stacking table 61 facing the rear plate 45 (on the top side of the paper stacking table 61 in FIG. 4). The rear protrusion portions 64 are inserted into the rear elevation holes 45*a* and project out of the erected member 41.

One of the frontal protrusion portions 63, one of the frontal elevation holes 43*a*, and one of the frontal axial support portions 43*b*, forming a single set of them, are disposed so as to substantially align on a straight line parallel to height direction Z (the same description applies to the remaining portions and hole 63, 43*a*, and 43*b*). The frontal axial support portion 43*b* is positioned above the frontal protrusion portion 63. One of the rear protrusion portions 64, one of the rear elevation holes 45*a*, and one of the rear axial support portions 45*b* likewise, forming a single set of them, are disposed so as to substantially align on a straight line parallel to height direction Z (the same description applies to the remaining portions and hole 64, 45*a*, and 45*b*).

The frontal regulating hole 65 is a rectangular hole elongated in width direction X and located near the front plate 43. Out of the frontal regulating hole 65, a frontal second regulating member 81 provided on the storage bottom plate 42 projects upward above the paper stacking table 61.

The rear regulating hole 66 is a rectangular hole elongated in width direction X and located near the rear plate 45. Out of the rear regulating hole 66, a rear second regulating member 82 provided on the storage bottom plate 42 projects upward above the paper stacking table 61.

The frontal second regulating member 81 and the rear second regulating member 82 form a pair of second regulating members facing each other in a direction parallel to the first side plate 44 (depth direction Y). The distance (regulating width KW) separating the frontal second regulating member 81 and the rear second regulating member 82 in depth direction Y is greater than the low-portion width RW. The regulating width KW is specified in accordance with the size of the printing paper stacked on the paper stacking table 61. The printing paper can be positioned properly by placing the printing paper in accordance with the frontal second regulating member 81 and the rear second regulating member 82. If the printing paper storage unit 40 is viewed from the side on which the first side plate 44 is provided (see FIG. 5), the frontal second regulating member 81 and the rear second regulating member 82 are located behind sidewall portions 44*c*, of the first side plate 44, that are erected higher than the paper stacking table 61, not behind the low erected portion 44*a*. The frontal second regulating member 81 and the rear second regulating member 82 are structured to slide in depth direction Y inside the frontal regulating hole 65 and the rear regulating hole 66 respectively and can be adapted to different printing paper sizes by changing the positions thereof.

The printing paper detecting hole 67 is a rectangular hole located near the second side plate 46. Printing paper on the paper stacking table 61 becomes detectable by providing, for example, an actuator (not shown) above the printing paper detecting hole 67. In this case, the actuator is disposed so that it can be partly inserted into the printing paper detecting hole 67. If there exists printing paper, the printing paper presses the actuator; if there exists no printing paper, the actuator is inserted into the printing paper detecting hole 67 without being activated. The presence/absence of printing paper can be hence detected. In addition, the actuator may be replaced with, for example, an optical sensor as a sensor detecting the presence/absence of printing paper. Light may be projected through the printing paper detecting hole 67 to detect printing paper using an optical sensor. Printing paper can be detected in accordance with whether or not the light is blocked by printing paper.

The storage bottom plate 42 is provided with a first regulating member 83 in the paper stack notch portion 62. The first regulating member 83 regulates the position of printing paper. The first regulating member 83 is structured to pivot around a regulating shaft 83*a* supported by the storage bottom plate 42 and in FIGS. 4 to 6, retracted below the paper stacking table 61. The first regulating member 83 as it is pivoted out of the retracted position will be described in detail in reference to FIG. 8.

The elevating unit 70 is composed primarily of two sets of one elevation roller 71, two pulleys 72, and two wires 73. One of the two sets is disposed on the front before the front plate 43, the other on the rear behind the rear plate 45. The elevation rollers 71 are supported pivotally beside the second side plate 46. A common shaft supports both of the elevation rollers 71. The shaft is supported by, for example, the front panel 33 and connected to drive means (not shown). On the front, the wires 73 wound around the elevation roller 71 are connected to the frontal protrusion portions 63 via the pulleys 72, and the pulleys 72 are supported pivotally on external faces of the frontal axial support portions 43*b*. On the rear, as is the case with the front, the wires 73 wound around the elevation roller 71 are connected to the rear protrusion portions 64 via the pulleys 72, and the pulleys 72 are supported pivotally on external faces of the rear axial support portions 45*b*. In other words, each of the two frontal protrusion portions 63 and the two rear protrusion portions 64 is associated with a different one of the wires 73 and a different one of the pulleys 72. The paper stacking table 61 is suspended by the wires 73. Next, a process of the elevating unit 70 moving up/down the paper stacking table 61 will be described in detail in reference to FIG. 7.

Figure 7:
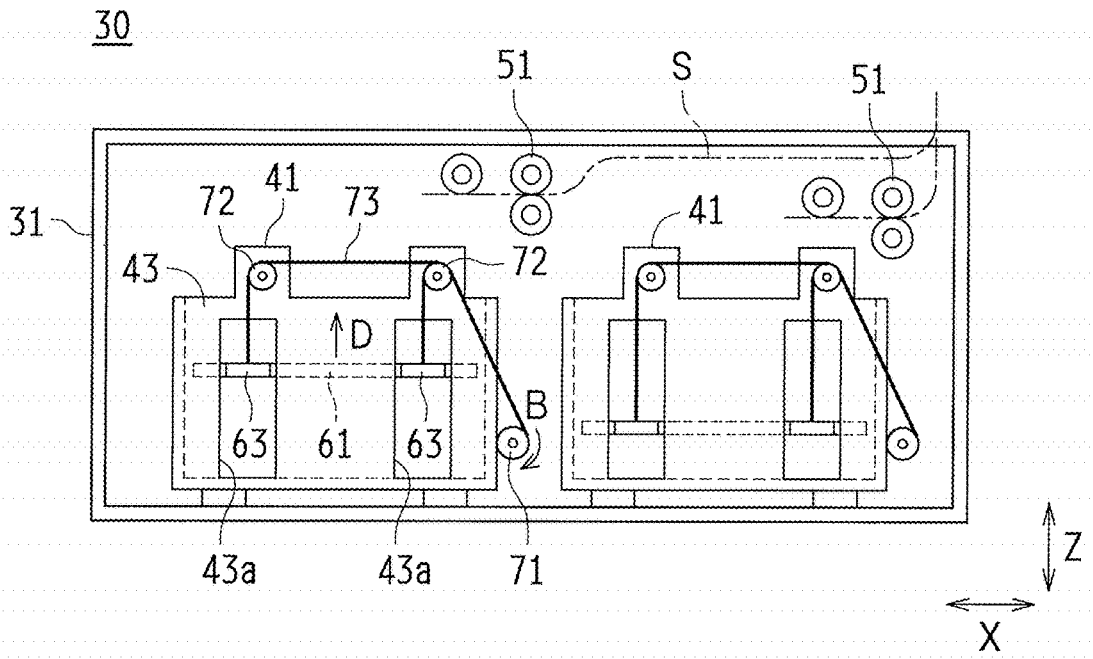
FIG. 7 is an illustration showing a paper stacking table being elevated.

FIG. 7 is an illustration showing one of the paper stacking tables 61 being elevated.

FIG. 7, as opposed to FIG. 3, shows one of the paper stacking tables 61 being elevated. As illustrated in FIG. 7, the elevation rollers 71 are driven to rotate in the direction indicated by arrow B to wind the wires 73. The paper stacking table 61 is being pulled by the wires 73 and elevated in the direction indicated by arrow D. The paper stacking table 61 is supported by the wires 73 at four positions separated by a distance both in width direction X and in depth direction Y. The four wires 73 are wound in a coordinated manner so that the paper stacking table 61 is elevated while maintaining the horizontal posture thereof. The paper stacking table 61 is structured to automatically fall under the weight thereof when the elevation rollers 71 are no longer driven. The paper stacking table 61 is regulated so as to maintain the stack height TL described earlier when there is no printing paper stacked thereon.

Figure 8:
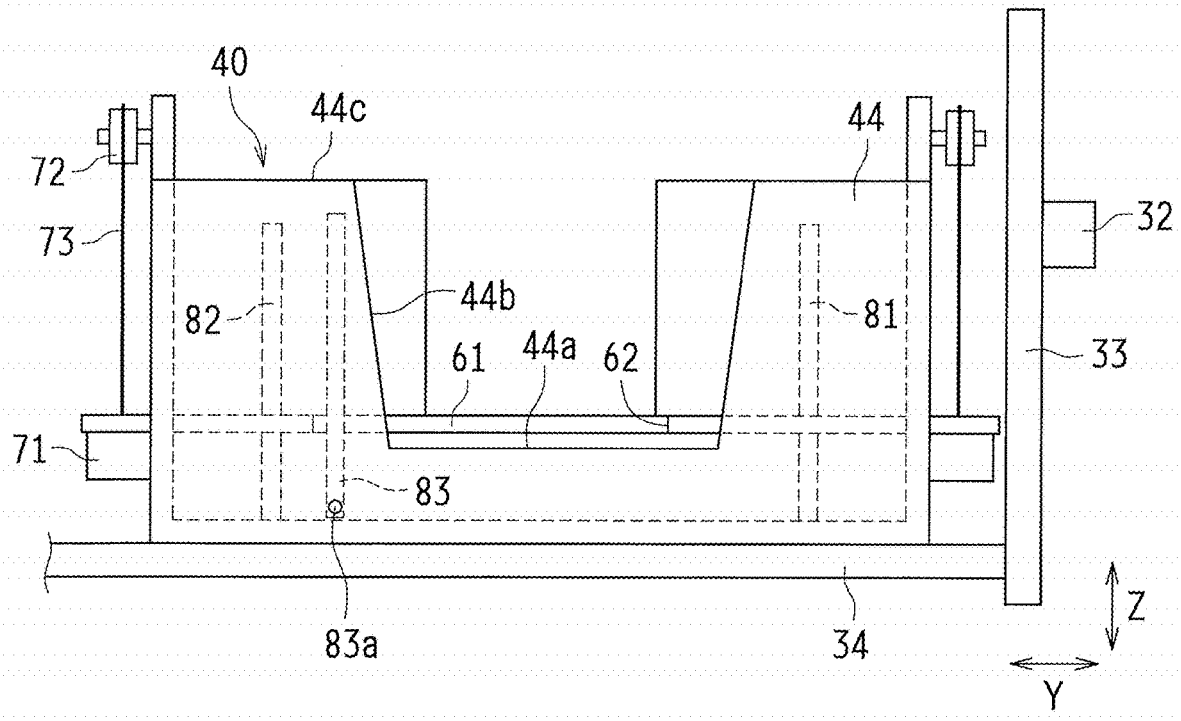
FIG. 8 is a schematic side view showing a pivoted first regulating member.

FIG. 8 is a schematic side view showing the first regulating member 83 having been pivoted.

FIG. 8, as opposed to FIG. 5, shows the first regulating member 83 having been pivoted so that the first regulating member 83, previously lying down on the storage bottom plate 42, is erected upright on the storage bottom plate 42. The first regulating member 83, when pivoted, has an end portion thereof opposite the regulating shaft 83*a* projecting upward above the paper stacking table 61. In this state, the regulating shaft 83*a* is located behind one of the sidewall portions 44*c*. Therefore, the first regulating member 83, erected on the storage bottom plate 42, is located not behind the low erected portion 44*a*, but behind the erected member 41 (more specifically, behind one of the sidewall portions 44*c*). The first regulating member 83 is located where it contacts one of the sides of the printing paper placed on the paper stacking table 61 other than those sides which the frontal second regulating member 81 and the rear second regulating member 82 contact. In other words, the first regulating member 83 and the pair of second regulating members 81 and 82 regulate the printing paper placed on the paper stacking table 61 in perpendicular directions.

As described earlier, in the present embodiment, the low erected portion 44*a* is formed lower than the paper stacking table 61. Therefore, the paper stacking table 61 has a partially open structure. This structure allows the user to, in stacking printing paper, extend his/her hand over the low erected portion 44*a* without touching the erected member 41. The user can hence stack printing paper smoothly. The structure can thus improve ease in paper restocking.

In addition, the second regulating members (the frontal second regulating member 81 and the rear second regulating member 82) are located at a distance from each other, the distance being greater than the width of the low erected portion 44*a*. This structure allows the user to extend his/her hand further over the low erected portion 44*a* into the printing paper storage unit 40 without touching the second regulating members. The user can hence stack printing paper smoothly.

Additionally, the provision of the paper stack notch portion 62 can ensure a space in which the paper stacking table 61 is not present. This structure allows the user to extend his/her hand further over the low erected portion 44*a* into the printing paper storage unit 40. The structure can thus further improve ease in paper restocking.

Furthermore, the provision of the first regulating member 83 can facilitate the positioning of printing paper. The first regulating member 83 can be readily disposed in any notched part of the paper stacking table 61.

Furthermore, the first regulating member 83 is disposed not behind the low erected portion 44*a*, but behind the erected member 41. This structure allows the user to extend his/her hand without touching the first regulating member 83. The user can readily change, for example, the size of the space for stacking printing paper by retracting the first regulating member 83 below the paper stacking table 61.

Furthermore, the low erected portion 44*a* is provided on a side of the printing paper storage unit 40 that comes out of the paper feed apparatus 30 when the printing paper storage unit 40 is pulled out. This structure can provide, at a suitable position, a large working space through which the user can extend his/her hand.

The two printing paper storage units 40 have substantially the same structure in the present embodiment. Alternatively, the printing paper storage units 40 may have different structures. For example, the size of the paper stacking table 61 may be made changeable so that printing paper of different sizes can be stored.

Next will be described paper feed apparatuses 30 in accordance with second and third embodiments of the present invention. The second and third embodiments have substantially the same configuration as the first embodiment, and no drawings are attached to illustrate the second and third embodiments.

The second embodiment differs from the first embodiment in that the second embodiment includes no first regulating member 83. The third embodiment differs from the first embodiment in that the third embodiment includes no first regulating member 83, no frontal second regulating member 81, and no rear second regulating member 82. In any of these cases, the second and third embodiments may be designed in a suitable manner as to whether to provide any frontal regulating hole 65 and rear regulating hole 66. Printing paper may be positioned properly using an erected member 41 in the second and third embodiments. Alternatively, the second and third embodiments may include no frontal second regulating member 81 and no rear second regulating member 82.

The embodiments disclosed herein are for illustrative purposes only in every respect and provide no basis for restrictive interpretations. The scope of the present invention is defined only by the claims and never bound by the specification. Those modifications and variations that may lead to equivalents of claimed elements are all included within the scope of the invention.

What is claimed is:

1. A paper feed apparatus comprising:

a printing paper storage unit configured to store paper to be fed by the paper feed apparatus; and a housing containing the printing paper storage unit, wherein the printing paper storage unit movably in and out of the housing by a user includes: a paper stacking table on which the printing paper is stacked, the paper stacking table moving in a printing paper stacking direction; and an erected member erected along a side of the paper stacking table, the erected member includes a side wall portion erected higher than the paper stacking table in the printing paper stacking direction and a low erected portion formed lower than the side wall portion in the printing paper stacking direction, the paper stacking table has a top face thereof located at a position as high as, or higher than the low erected portion in the printing paper stacking direction, the paper stacking table has a paper stack notch portion formed along a side of the paper stacking table that faces the low erected portion, wherein the paper stack notch portion is open to the low erected portion and to the side wall portion, the printing paper storage unit includes a first regulating member in the paper stack notch portion, the first regulating member being configured to regulate a position of the printing paper stacked on the paper stacking table, the first regulating member is configured to pivot around a supporting point that is a regulating axis disposed at a position facing the side wall portion, and when the first regulating member is pivoted and erected, the first regulating member faces only the side wall portion, and when the first regulating member is pivoted and laid down, the first regulating member faces the low erected portion and the side wall portion.

2. The paper feed apparatus according to claim 1, wherein the paper stack notch portion is formed by cutting out a part of the paper stacking table.

3. The paper feed apparatus according to claim 1, wherein the printing paper storage unit includes a pair of second regulating members configured to regulate the position of the printing paper stacked on the paper stacking table, the pair of second regulating members faces each other in a direction perpendicular to a direction in which the first regulating member regulates the printing paper, and the pair of second regulating members is separated from each other by a distance greater than a width of the low erected portion in the direction in which the pair of second regulating members faces each other.

4. The paper feed apparatus according to claim 1, wherein the paper feed apparatus further comprises a manual operating portion disposed on a front face of the housing, the manual operating portion being configured to, when operated, allow the printing paper storage unit to be pulled out of the housing, and the low erected portion is disposed in a direction parallel to a direction in which the printing paper storage unit is pulled out of the housing.

5. An image forming apparatus comprising the paper feed apparatus according to claim 1, the image forming apparatus forming an image on the printing paper fed from the paper feed apparatus.

6. The paper feed apparatus according to claim 1, wherein when the first regulating member is pivoted and erected, the first regulating member projects above the low erected portion in the printing paper stacking direction, and when the first regulating member is pivoted and laid down, the first regulating member retracts below the low erected portion.

* * * * *